United States Patent [19]

Norimatsu et al.

[11] 4,111,162

[45] Sep. 5, 1978

[54] METHOD AND SYSTEM FOR CONTROLLING THE MIXTURE AIR-TO-FUEL RATIO

[75] Inventors: Hideaki Norimatsu; Akio Kobayashi; Akira Masuda; Sigenori Kitajima, all of Kariya, Japan

[73] Assignee: Nippondenso Co., Ltd., Kariya, Japan

[21] Appl. No.: 690,628

[22] Filed: May 27, 1976

[30] Foreign Application Priority Data

Jun. 10, 1975 [JP] Japan ..... 50-70296
Jun. 17, 1975 [JP] Japan ..... 50-73969

[51] Int. Cl.[2] ..... F02B 3/00
[52] U.S. Cl. ..... 123/32 EE; 123/119 EC
[58] Field of Search ..... 123/32 EA, 32 EE, 119 EC; 60/276, 285

[56] References Cited

U.S. PATENT DOCUMENTS

| | | | |
|---|---|---|---|
| 3,759,232 | 9/1973 | Wahl et al. | 60/276 |
| 3,782,347 | 1/1974 | Schmidt et al. | 60/276 |
| 3,831,564 | 8/1974 | Schmidt et al. | 123/32 EE |
| 3,874,171 | 4/1975 | Schmidt et al. | 123/32 EE |

*Primary Examiner*—Samuel Feinberg
*Attorney, Agent, or Firm*—Cushman, Darby & Cushman

[57] ABSTRACT

A closed loop air-to-fuel ratio control system having an oxygen responsive sensor and a feedback circuit is disclosed. The sensor is disposed in an engine exhaust passage to produce a voltage indicative of the oxygen concentration in the exhaust gas. This voltage is integrated in the feedback circuit to cause the mixture air-to-fuel ratio to be corrected in response thereto. The integration is controlled by the integration controller to shift the mixture air-to-fuel ratio to the one other than the stoichiometric ratio. This integration controller can be made responsive to specific engine operating conditions such as throttle valve movement.

2 Claims, 10 Drawing Figures

METHOD AND SYSTEM FOR CONTROLLING THE MIXTURE AIR-TO-FUEL RATIO

BACKGROUND OF THE INVENTION (1) Field of the Invention

The present invention relates to an air-to-fuel ratio control system for an internal combustion engine, and more particularly to a system wherein the air-to-fuel ratio of the mixture can be controlled to the one other than the stoichiometric ratio.

(2) Description of the Prior Art

Closed loop air-to-fuel ratio control systems have been highly appreciated for purifying exhaust gases emitted from internal combustion engines. One of these techniques is disclosed in U.S. Pat. No. 3,910,240. This disclosed technique is available for controlling air-fuel mixture to a richer or leaner mixture than the stoichiometric ratio, but does not suffice for practical use in that engine cylinders must be supplied with the mixture of different air-to-fuel ratios to each other requiring more than two mixture supply sources.

SUMMARY OF THE INVENTION

It is, therefore, a primary object of the invention to control the mixture air-to-fuel ratio to one other than the stoichiometric ratio with one mixture supply source.

It is another object of the invention to control the mixture air-to-fuel ratio in response to specific engine operation conditions.

It is a further object of the invention to delay the sensor output voltage prior to the integration thereof.

It is a still further object of the invention to integrate the sensor output voltage in increasing and decreasing directions with respective different integration constants.

Other objects and advantages of the invention will become apparent from the following description.

DETAILED DESCRIPTION OF THE PREFERRED EMBODIMENT

Figure 1:
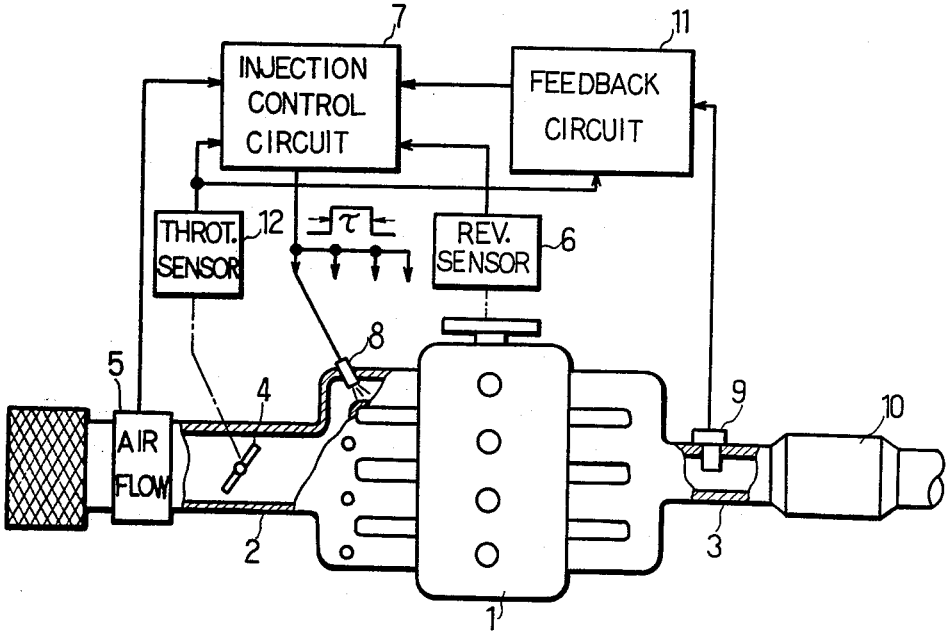
FIG. 1 is a schematic view illustrating a first embodiment of the present invention.

Referring first to FIG. 1, a 4-cylinder internal combustion engine 1 is provided with an intake pipe 2 and an exhaust pipe 3. A throttle valve 4 is pivotally mounted in the intake pipe 2 to control the air amount flowing therethrough. The air flow amount is detected by an air flow sensor 5 disposed upstream of the throttle valve 4. An engine revolution sensor 6 is coupled to the engine 1 to detect the engine rotational speed. The electronic fuel injection control circuit 7 is electrically connected to the sensors 5 and 6 to receive therefrom electric signals indicative of the air flow amount and the rotational speed, respectively. Other sensors for detecting engine operating conditions such as engine coolant temperature and engine cranking may be connected to the injection control circuit 7 as well. The control circuit 7, receiving these electric signals, generates a pulse signal which is to be supplied to electromagnetically operable fuel injectors 8 for supplying the air-fuel mixture of the stoichiometric ratio. The pulse duration $\tau$ of the pulse signal is dependent on the electric signals indicative of the operating conditions and determines the fuel amount to be supplied to the engine 1. An oxygen responsive sensor ($O_2$-sensor) 9 is secured to the exhaust pipe 3 for detecting the oxygen concentration or the oxygen partial pressure in the exhaust gas flowing therethrough and a 3-way catalytic converter 10 is disposed downstream thereof.

Figure 2:
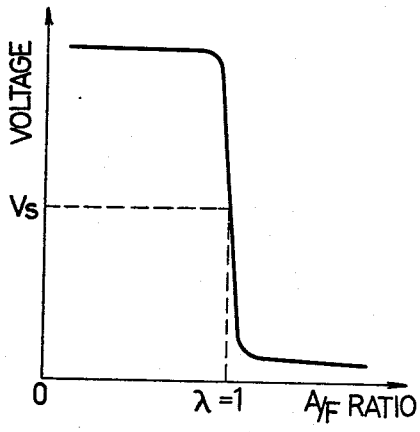
FIG. 2 is a graph showing the output voltage characteristics of the oxygen responsive sensor shown in FIG. 1.
Figure 3:
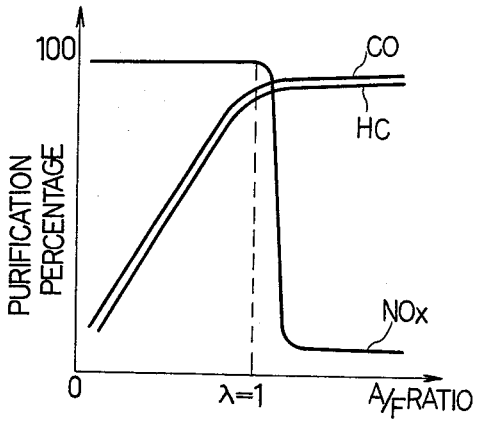
FIG. 3 is a graph showing the exhaust gas purification characteristics of a catalytic converter shown in FIG. 1.

The output voltage characteristics of the $O_2$-sensor 9 are shown in FIG. 2, wherein the abscissa and the ordinate respectively represent the mixture air-to-fuel ratio and the output voltage. The output voltage level of the $O_2$-sensor 9 is, as well known, high and low for the lesser ratio (the richer mixture) and for the greater ratio (the leaner mixture), respectively and it abruptly changes from one level to the other at the stoichiometric ratio (air number $\lambda=1$) above which oxygen is present in the exhaust gas. The purification characteristics of the converter 10 are shown in FIG. 3, wherein the abscissa and the ordinate respectively represent the air-to-fuel ratio and the purification percentage. The purification percentages is very high around the stoichiometric ratio ($\lambda=1$) for all the exhaust gas components, nitrogen oxides ($NO_x$), carbon monoxide (CO) and hydro carbons (HC). It should be noted in FIG. 3 that the mixture air-to-fuel ratio must be controlled to the lesser ratio ($\lambda<1$) when purifying $NO_x$ component is mainly required, whereas it must be controlled to the greater ratio ($\lambda>1$) when purifying HC and CO components is mainly required.

Referring back to FIG. 1, a feedback circuit 11 is connected between the $O_2$-sensor 9 and the injection control circuit 7 to control the air-to-fuel ratio of the mixture to the stoichiometric ratio around which the exhaust gas purification ability of the 3-way catalytic converter 10 is excellent. The feedback circuit 11 shortens and lengthens the pulse duration $\tau$ while the high output voltage and the low output voltage are applied from the $O_2$-sensor, respectively. A throttle sensor 12, operatively coupled to the throttle valve 4, is also connected to the feedback circuit 11 to provide an electric signal indicative of the closure of the valve 4. The sensor 12 may be connected to the injection control circuit 7 in the conventional manner as well to cause fuel supply cut-off upon engine deceleration.

Figure 4:
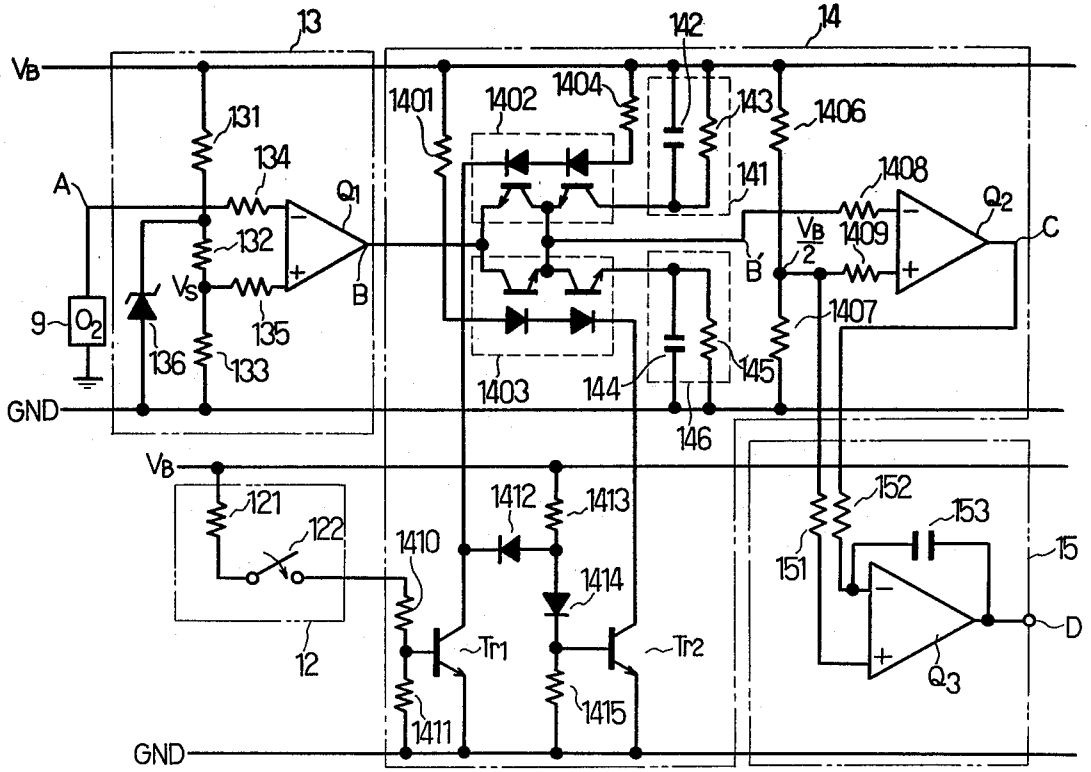
FIG. 4 is an electric wiring diagram of a feedback circuit shown in FIG. 1.
Figure 5:
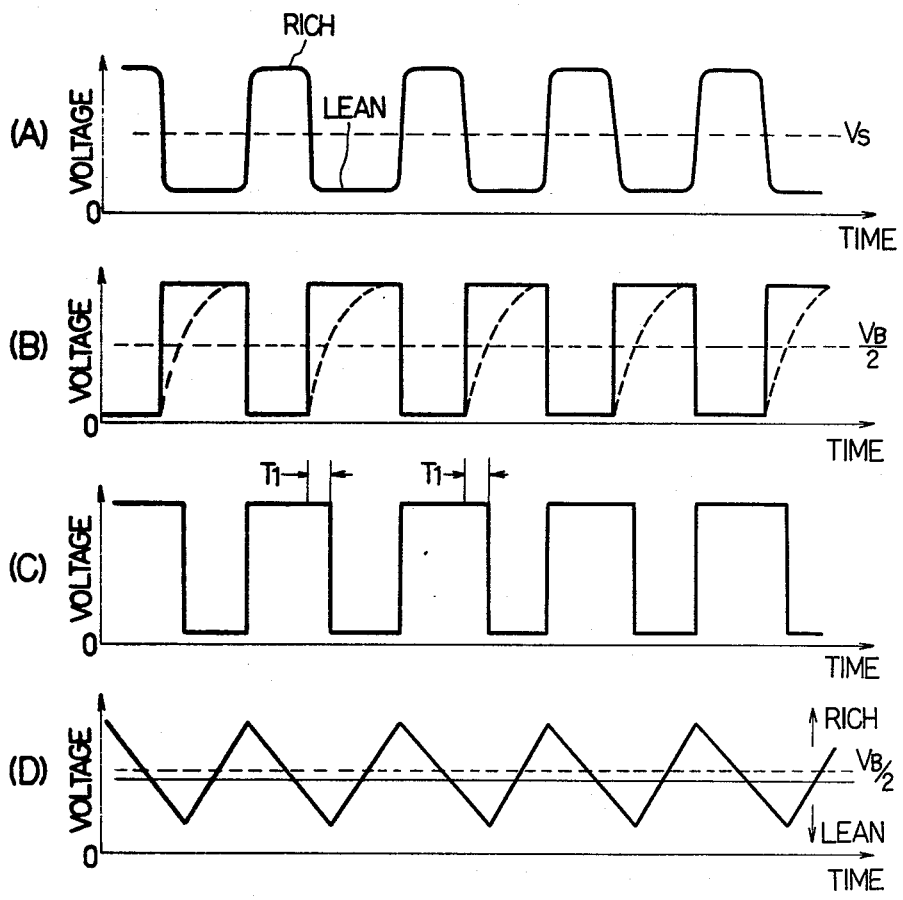
FIG. 5 is a graph showing signal waveforms (A) to (D) appearing at respective points A to D in FIG. 4 under one engine operating condition.
Figure 6:
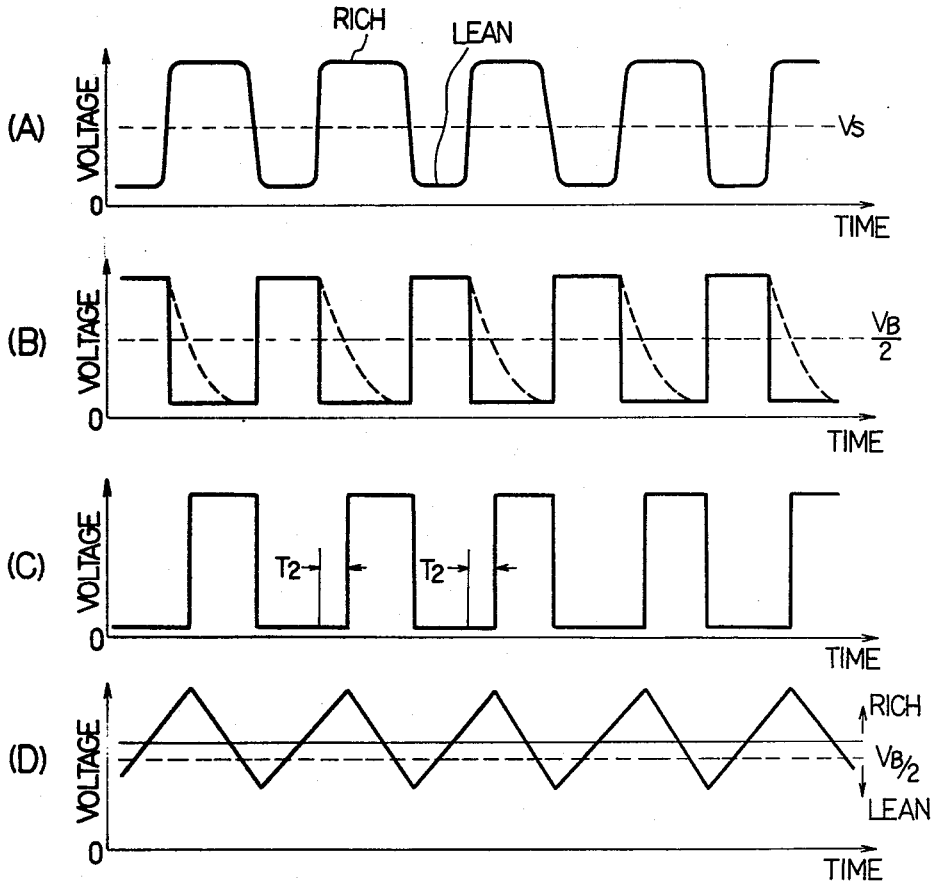
FIG. 6 is a graph showing signal waveforms (A) to (D) appearing at respective points A to D in FIG. 4 under the other engine operating condition.

The feedback circuit 11 is comprised of a comparison circuit 13, an integration control circuit 14 and an integration circuit 15 as shown in FIG. 4. In this figure, $V_B$ designates a voltage potential of a battery (not shown) and GND designates the ground potential. The comparison circuit 13, connected to the $O_2$-sensors 9 at a terminal A, is constructed with resistors 131 to 135, a zener diode 136 and an operational amplifier $Q_1$. The output voltage of the $O_2$-sensor 9 is applied to the negative terminal (−) of the amplifier $Q_1$ through the resistor 134, whereas voltage $V_s$ is applied to the positive terminal (+) of the amplifier $Q_1$ through the resistor 135. The voltage $V_s$ is regulated to be constant by the resistors 132 and 133 and the zener diode 136 and equal to the $O_2$-sensor output voltage indicative of the stoichiometric ratio of the mixture. The comparison circuit 13 produces at an output terminal B a high level voltage while the $O_2$-sensor output voltage is lower than the set voltage $V_s$, whereas it produces a low level voltage while the former is higher than the latter. In FIGS. 5 and 6 the output voltage change of the comparison circuit 13 at the terminal B is shown in (B) with respect to the output voltage change (A) of the $O_2$-sensor 9 at the terminal A.

The integration control circuit 14 is constructed with resistors 1401, 1404, 1406, 1407, 1408, 1409, 1410, 1411, 1413 and 1415, photo-couplers 1402 and 1403, delay circuits 141 and 146, diodes 1412, 1414, transistors Tr1 and Tr2 and an operational amplifier $Q_2$. The photocouplers 1402 and 1403 are connected in common to the output terminal B of the comparison circuit 13 and to the negative terminal (−) of the amplifier $Q_2$ through the resistor 1408. The series-connected resistors 1406 and 1407 divide the voltage $V_B$ and supply the reference voltage $V_{B/2}$ to the positive terminal (+) of the amplifier $Q_2$ through the resistor 1409. The photo-coupler 1402 is further connected to the $V_B$ line through the resitor 1404 and to the GND line through the transistor Tr1, whereas the photo-coupler 1403 is connected to the $V_B$ lin through the resistor 1401 and to the GND line through the transistor Tr2. The delay circuits 141 and 146, each comprising parallel-connected capacitor and resistor, are respectively connected between the $V_B$ line and the photo-coupler 1402 and between the photo-coupler 1403 and the GND line.

The throttle sensor 12 is constructed with a resistor 121 connected to the $V_B$ line and an on-off switch 122 connected in series therewith. The switch 122 is so connected as to close only when the above described throttle valve 4 is closed. The throttle sensor 12, being connected to the integration control circuit 14 and more particularly to the transistor Tr1 through the resistor 1410, controls the on-off condition of the transistors Tr1 and Tr2.

Connected to the integration control circuit 14 is the integration circuit 15 which is constructed with an operational amplifier $Q_3$, input resistors 151 and 152 and a capacitor 153 connected across the amplifier $Q_3$. The junction of the resistors 1406 and 1407 and the output terminal C of the amplifier $Q_2$ are connected to the positive terminal (+) and the negative terminal (−) of the amplifier $Q_3$ through resistors 151 and 152, respectively. The output terminal D of the amplifier $Q_3$ is connected to the above described injection control circuit 7 in the known manner to correct the fuel injection amount.

During engine deceleration and idling conditions the throttle valve 4 is closed and the on-off switch 122 is eventually closed to supply the transistor Tr1 with the high voltage. As a result the transistors Tr1 and Tr2 are rendered conductive and nonconductive, respectively. The conduction of the transistor Tr1 causes the photocoupler 1402 to be turned on allowing the comparison-resultant voltage at the terminal B to be transmitted to the terminal B′ therethrough. It should be understood herein that transmitting the high level voltage at the terminal B is delayed by the delay circuit 141. The delay-resultant voltage change at the terminal B′ is supplementarily shown in (B) of FIG. 5 with a dotted line. The voltage increasing rate at the terminal B′ is dependent on a time constant determined by the capacitor 142 and the resistor 143 of the delay circuit 141.

The delay-resultant voltage at the terminal B′ is compared with the set voltage $V_{B/2}$ by the amplifier $Q_2$, which in turn produces, as shown in (C) of FIG. 5, high and low level voltages at a terminal C when the former is lower and higher than the latter, respectively. As can be seen from the voltage waveform (C) of FIG. 5, duration of the high level voltage indicative of the rich mixture is lengthened by the constant time period $T_1$ with respect to the one derived from the $O_2$-sensor 9.

The integration circuit 15 integrates the output voltage at the terminal C and produces a gradually changing voltage at the terminal D as shown in (D) of FIG. 5. The integration-resultant voltage changes in increasing and decreasing directions in response to the low and high level output voltages at the terminal C, respectively. The voltage increasing rate is equal to the voltage decreasing rate inasmuch as the integration constant determined by the resistor 152 and the capacitor 153 is constant. The integration in the decreasing direction continues further during the period $T_1$ even after the voltage of the $O_2$-sensor 9 is reversed from high level indicative of the rich mixture to the low level indicative of the lean mixture, resulting in that the average integration voltage becomes lower than the set voltage $V_{B/2}$. The set voltage $V_{B/2}$ and the average integration voltage are shown in (D) of FIG. 5 with the dotted straight line and the solid straight line, respectively.

Depending upon the integration-resultant voltage, the injection pulse duration is corrected in such a manner that it is shortened and lengthened when the integration voltage is lower and higher than the set voltage $V_{B/2}$. The pulse duration correction is not made when the integration voltage is equal to the set voltage $V_{B/2}$, provided that the injection control circuit 7 can provide the pulse signal corresponding to the stoichiometric ratio. As the average integration voltage is lower than the set voltage $V_{B/2}$, the correction-resultant mixture air-to-fuel ratio is controlled to the one greater than the stoichiometric ratio. To this end, the engine 1 can be supplied with the leaner air-fuel mixture during the throttle valve closing and the converter 10 can purify HC and CO components with high purification percentage.

On the other hand, the on-off switch 122 of the throttle sensor 12 is kept open during the engine normal running and acceleration conditions and the transistors Tr1 and Tr2 are respectively rendered nonconductive and conductive. The photo-coupler 1403 is turned on in response to the conduction of the transistor Tr2 allowing the comparison-resultant voltage at the terminal B to be transmitted to the terminal B′ therethrough. It should be understood herein again that transmitting the low level voltage at the terminal B is delayed by the delay circuit 146. The delay-resultant voltage change at the terminal B' is supplementarily shown in (B) of FIG. 6 with a dotted line. The voltage decreasing rate at the terminal B' is dependent on a time constant determined by the capacitor 144 and the resistor 145 of the delay circuit 146.

This delay-resultant voltage is then compared with the set voltage $V_{B/2}$ by the amplifier $Q_2$, which in turn produces high and low level voltages at the terminal C in the quite same manner described hereinabove. As can be seen from the voltage waveform (C) of FIG. 6 showing the voltage change at the terminal C, duration of the low level voltage indicative of the lean mixture is lengthened by the constant time period $T_2$ with respect to the one derived from the $O_2$-sensor 9.

The integration circuit 15 integrates the output voltage at the terminal C and produces a gradually changing voltage at the terminal D as shown in (D) of FIG. 6. The integration voltage changing direction changes in response to the voltage level at the terminal C as is the above described case, but integration duration in the increasing direction continues longer by the period $T_2$ after the output voltage of the $O_2$-sensor 9 is reversed from the low level to the high level. To this end, the average integration-resultant voltage shown with the straight solid line becomes higher than the set voltage $V_{B/2}$ shown with the straight dotted line. Correcting the injection pulse duration in response to this integration voltage causes the mixture air-to-fuel ratio to be lesser than the stoichiometric ratio. The $NO_x$ component in the exhaust gas, therefore, can be reduced by the converter 10 with high purification percentage therefor during the engine normal and accelerating conditions.

Figure 7:
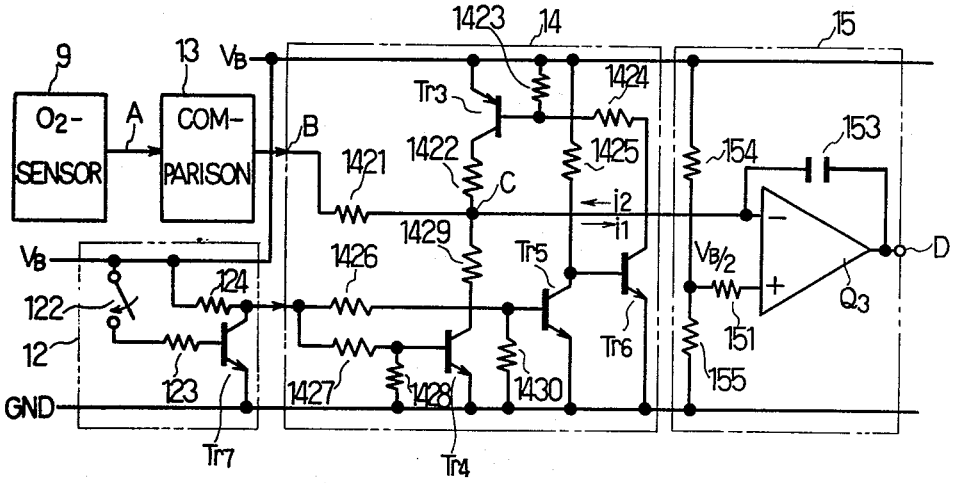
FIG. 7 is an electric wiring diagram of the feedback circuit according to the second embodiment of the invention.

Second embodiment of the invention is shown in FIG. 7, wherein circuit construction of the integration control circuit 14 and the integration circuit 15, in combination with the throttle sensor 12, are illustrated in detail. The $O_2$-sensor 9 and the comparison circuit 13 can be constructed in such a manner described with respect to FIG. 4. The integration control circuit 14, connected to the comparison circuit 13 and the throttle sensor 12, is constituted with resistors 1421 through 1430 and transistors Tr3, Tr4, Tr5 and Tr6. The throttle sensor 12 is constituted with the above described throttle valve responsive on-off switch 122, resistors 123 and 124 and a transistor Tr7. The integration circuit is constructed in the same manner as the first embodiment except that the negative terminal (−) of the amplifier $Q_3$ is connected to the junction C.

Figure 8:
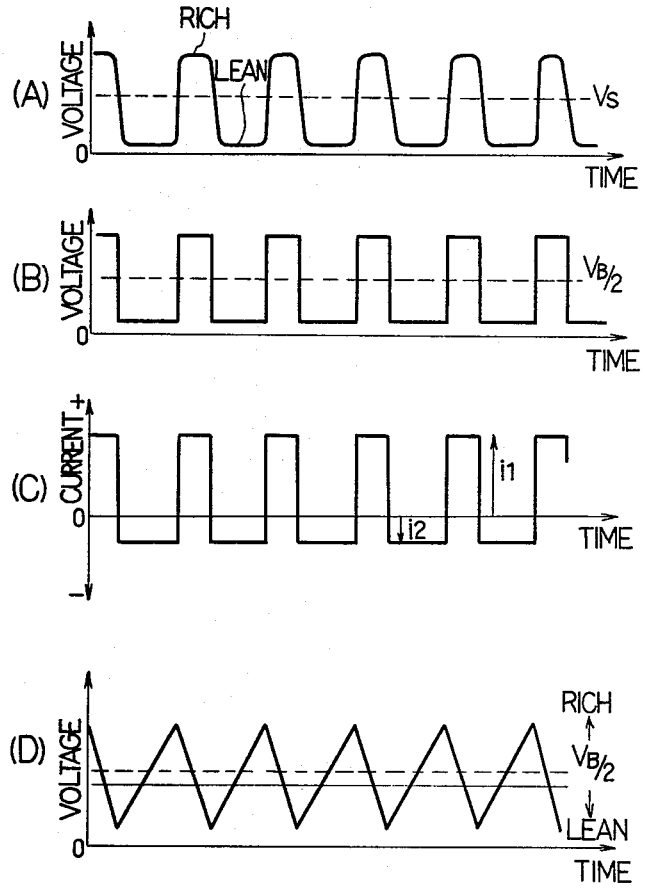
FIG. 8 is a graph showing a signal waveforms (A) to (D) appearing at respective points A to D in FIG. 7 under one engine operating condition.
Figure 9:
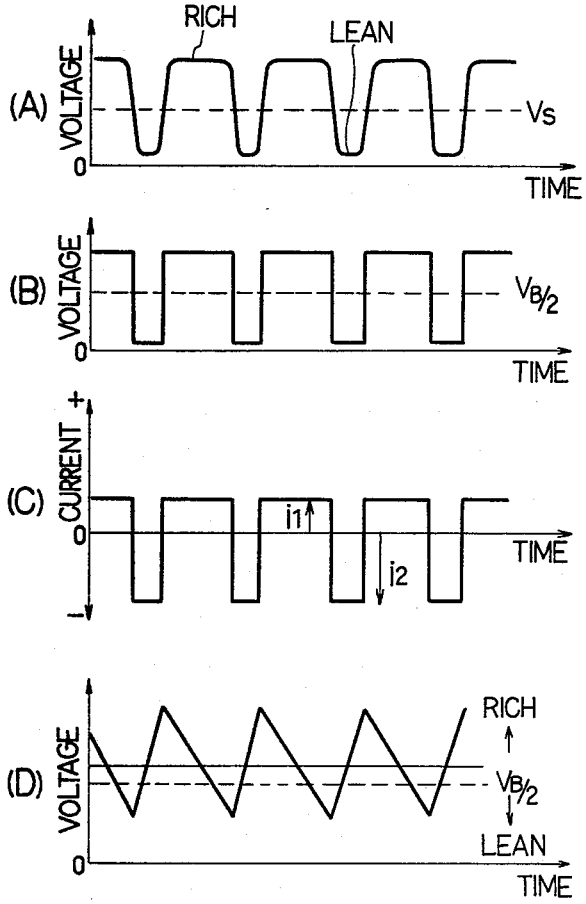
FIG. 9 is a graph showing signal waveforms (A) to (D) in FIG. 7 under the other engine operating condition.

The $O_2$-sensor output voltage at the terminal A is shown in (A) of FIGS. 8 and 9 and the comparison-resultant voltage at the terminal B is shown in (B) of FIGS. 8 and 9. It should be noted herein that level of the comparison-resultant voltage in FIGS. 8 and 9 is reversed contrary to the one shown in (B) of FIGS. 5 and 6.

During the engine idling and deceleration the on-off switch 122 of the throttle sensor 12 closes in response to the throttle valve closing, rendering the transistor Tr7 conductive. The conduction of the transistor Tr7 is followed by the nonconduction of the transistor Tr4 and Tr5 and the conduction of the transistor Tr3 and Tr6 in the integration circuit 14. On this occasion, electric current flows between the terminal C of the integration circuit 14 and the amplifier $Q_3$ of the integration circuit. The current $i_1$ flows from the terminal C into the amplifier $Q_3$ when the high level output voltage is appearing at the terminal B, whereas the current $i_2$ flows in the reverse direction when the low level output voltage is appearing at the terminal B. The current $i_1$ is equal to the summation of two currents, one flowing from the $V_B$ line through the transistor Tr3 and the resistor 1422 and the other from the terminal B through the resistor 1421. The current $i_2$, however, is equal to the subtraction of the two currents, each thereof flowing through the resistor 1421 and the resistor 1422. As a result, the current $i_1$ is greater than the current $i_2$ as shown in (C) of FIG. 8.

Integrating the currents $i_1$ and $i_2$ in the integration circuit 15 causes the integration voltage at the terminal D in the decreasing direction and the increasing direction, respectively. And voltage changing rate with respect to the time in the decreasing direction and the increasing direction is dependent on the corresponding currents $i_1$ and $i_2$ as shown in (D) of FIG. 8. Inasmuch as the integration voltage increases more slowly than it decreases, the average integration voltage becomes lower than the set voltage $V_{B/2}$ which is constantly supplied to the positive terminal (+) of the amplifier. The average integration voltage, which in turn represents the average air-to-fuel ratio resulting from the feedback control, is shown in (D) of FIG. 8 with the solid straight line.

Contrary to the engine idling and deceleration the on-off switch 122 of the throttle sensor 12 is kept open during the engine normal running and acceleration, rendering the transistor Tr7 nonconductive. In response to the nonconduction of the transistor Tr7 the transistors Tr4 and Tr5 are turned on and the transistors Tr3 and Tr6 are turned off. On this occasion, the currents $i_1$ and $i_2$ flow in response to the high level voltage and the low level voltage at the terminal B, respectively, and the current $i_2$ becomes greater than the current $i_1$ as shown in (C) of FIG. 9. The integration circuit 15, alternately receiving these currents $i_1$ and $i_2$ at the negative terminal (−) of the amplifier $Q_3$, produces the integration voltage at the terminal D as shown in (D) of FIG. 9. Since the current $i_2$ is greater than the current $i_1$ in this case, the integration voltage increases more rapidly than it decreases causing the average integration voltage to be higher than the set voltage $V_{B/2}$.

In this second embodiment described hereinabove, the integration constant is controlled by varying the impedance of the integration control circuit 14 connecting the comparison circuit 13 and the integration circuit 15 to thereby shift the average integration voltage to the one other than the set voltage $V_{B/2}$. Correcting the fuel injection amount in accordance with the integration voltage enables the mixture air-to-fuel ratio to be shifted to the greater or lesser ratio.

Figure 10:
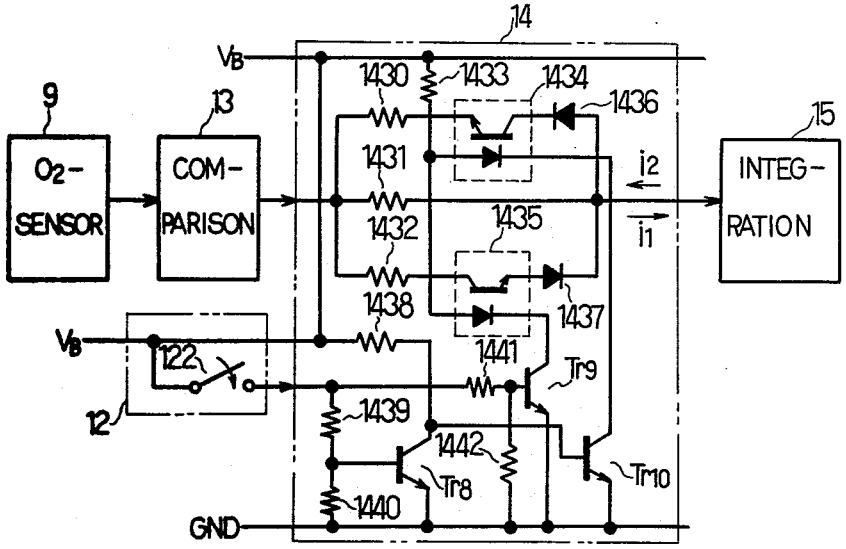
FIG. 10 is an electric wiring diagram of the feedback circuit according to the third embodiment of the invention.

Third embodiment of the invention is shown in FIG. 10, wherein circuit construction of the integration control circuit 14 is mainly illustrated in detail. The integration control circuit 14 is constructed with resistors 1430 through 1433 and 1438 through 1442, photo-couplers 1434 and 1435, diodes 1436 and 1437 and transistors Tr8 through Tr10. With this construction the throttle sensor 12 turns on the transistors Tr8 and Tr9 and turns off the transistor Tr10 during the throttle valve closing, rendering one photo-coupler 1435 conductive. When the comparison circuit 13 applies the high level voltage to the junction of the three resistors 1430, 1431 and 1432, the current $i_1$ flows into the integration circuit 15 through the resistors 1431 and 1432. When the comparison circuit 13, on the other hand, applies the low level voltage, the current $i_2$ flows into the above junction only through the resistor 1431. The impedance between the comparison circuit 13 and the integration circuit 15 becomes lower when the current $i_1$ flows than when the current $i_2$ flows, resulting in that the average integration voltage becomes lower than the set voltage $V_{B/2}$ as is the case of FIG. 8.

During the engine normal and acceleration conditions, on the other hand, only the transistor Tr10 and the photo-coupler 1434 are kept conductive. To this end, the currents $i_1$ and $i_2$ flow in response to the respective high level and low level comparison-resultant voltages and the current $i_2$ becomes greater than the current $i_1$, resulting in that the average integration voltage becomes lower than the set voltage $V_{B/2}$ as is the case of FIG. 9. The mixture air-to-fuel ratio, therefore, can be controlled to the one other than the stoichiometric ratio in response to the throttle valve movement.

It should be noted that the mixture air-to-fuel ratio can be corrected to the one other than the stoichiometric ratio in response to not only the throttle valve movement but other engine operating conditions and that it can be constantly corrected irrespective of the engine operating conditions without departing from the scope of this invention.

What we claim is:

1. An air-to-fuel ratio control system for an internal combustion engine comprising:

mixture supply means, provided in an intake passage of an engine, for supplying an air-fuel mixture thereto;

oxygen responsive means, provided in an exhaust passage of said engine, for producing a detection signal which changes the signal level thereof to indicate the absence and the presence of oxygen in said exhaust passage;

integration means, connected between said oxygen responsive means and said mixture supply means, for producing an integration signal changing in increasing and decreasing directions in response to the level of said detection signal to thereby correct the mixture air-to-fuel ratio, said integration means being adapted to change the signal level of said integration signal at a constant speed;

throttle condition detection means, coupled to the throttle valve of said engine, for producing a condition signal when said throttle valve is opened from the fully closed angle; and integration control means, connected between said oxygen responsive means and said integration means and responsive to said throttle condition detection means, for controlling said detection signal prior to the integration thereof in response to said condition signal such that the changing rate of said integration signal with respect to the duration of said detection signal is made different between said increasing and decreasing directions, whereby the mixture air-to-fuel ratio is changed from a first ratio to a second ratio when said throttle valve is opened from the fully closed angle, said integration control means including a first delay circuit for delaying one of the signal levels of said detection signal by a predetermined time while said condition signal is generated such that the integration in one direction between said increasing and decreasing directions is kept further during said predetermined time, and a second delay circuit for delaying the other of the signal levels of said detection signal by another predetermined time while said condition signal is not generated such that the integration in the other direction between said increasing and decreasing directions is kept further during said another predetermined time.

2. An air-to-fuel ratio control system for an internal combustion engine comprising:

an oxygen sensor, provided in an exhaust passage of said engine, for producing a detection signal which changes the signal level thereof when the oxygen concentration changes between the absence and the presence;

a delay circuit, connected to said oxygen sensor, for delaying said detection signal by a time constant determined by a resistor and a capacitor and producing a delay signal which changes the signal level thereof more slowly than said detection signal only at either time when the oxygen concentration is changed from the absence to the presense or when the oxygen concentration is changed from the presence to the absence;

a comparison circuit, connected to said delay circuit, for comparing the signal level of said delay circuit with a constant level and generating a pulse signal having a first constant level and a second constant level on and the other of which have longer and shorter durations than the signal levels of said detection signal, respectively;

an integration circuit, connected to said comparison circuit, for integrating said pulse signal with respect to time and producing an integration signal which increases and decreases while said pulse signal remains at said first constant level and at said second constant level, respectively; and mixture control means for controlling the air-to-fuel ratio of mixture to be supplied to said engine in accordance with said integration signal, whereby said air-to-fuel ratio is controlled to the one other than the stoichiometric ratio.

* * * * *